United States Patent [19]

Parente

[11] Patent Number: 4,503,637

[45] Date of Patent: Mar. 12, 1985

[54] SLIDING DOOR SYSTEM

[76] Inventor: Jerry Parente, 2061 SW. 136 Ave., Davie, Fla. 33325

[21] Appl. No.: 395,842

[22] Filed: Jul. 6, 1982

[51] Int. Cl.[3] ..... E05B 65/10; E05C 7/06

[52] U.S. Cl. ..... 49/141; 49/118; 49/360; 49/411; 49/425

[58] Field of Search ..... 49/141, 118, 409, 410, 49/411, 425, 360

[56] References Cited

U.S. PATENT DOCUMENTS

| | | | |
|---|---|---|---|
| 1,881,015 | 10/1932 | Ayers | 49/409 X |
| 2,791,005 | 5/1957 | Thompson | 49/409 |
| 3,300,897 | 1/1967 | Wikkerink | 49/141 X |
| 3,425,162 | 2/1969 | Halpern | 49/425 |
| 3,466,805 | 9/1969 | Muessel | 49/141 |
| 3,523,390 | 8/1970 | McAulay, Jr. | 49/411 |
| 3,670,455 | 6/1972 | Slaybaugh | 49/141 X |
| 3,727,349 | 4/1973 | Bainbridge | 49/411 |
| 3,834,081 | 9/1974 | Catlett | 49/118 X |
| 4,050,191 | 9/1977 | Azuma | 49/118 X |
| 4,142,326 | 3/1979 | Schmitz | 49/118 |
| 4,290,368 | 9/1981 | Mazzini | 49/141 X |

FOREIGN PATENT DOCUMENTS

| | | | |
|---|---|---|---|
| 692399 | 8/1964 | Canada | 49/141 |

*Primary Examiner*—Philip C. Kannan

*Attorney, Agent, or Firm*—Malin, Haley & McHale

[57] ABSTRACT

A sensor activated, automatic sliding door assembly for installation in building entrance openings for automatic opening and closing of sliding doors. The roller track, drive belt pulley, door carrier, and door guide allow adjustment to compensate for distortion of the system as a result of stress caused by use or expansion and contraction of the building. The rotatable safety hinges, one-way hinges, door stops and electrical interruptors provide integrated safety devices to the automatic door assembly. Linear sliding devices such as linear bearings provide improved movement of the sliding doors on a linear track.

12 Claims, 9 Drawing Figures

SLIDING DOOR SYSTEM

BACKGROUND OF THE INVENTION

This invention relates to a new and improved sensor activated, automatic door assembly which is attached to a building to provide support and control for the automatic opening and closing of sliding doors. The presently existing automatic door systems are provided by a small number of manufacturers who specially design and construct the components of the system to their own special specifications. As a result, the components of the various systems are not compatible or interchangeable. Experience has shown that repair and replacement of these systems is costly and time consuming. Repairs are often delayed because of dependency upon the availability of parts and service from the original manufacturer. As a result of the complexity of the systems minor repairs, servicing and replacement cannot be accomplished by the user. In addition, components of existing automatic door systems exhibit certain deficiencies and inadequacies in their design and construction which limit their installation, adjustment and repair, such as: the operator-header support beams tend to distort from the weight and operation of the system causing malfunctions and also are not adaptable to installation on the front surface of building fronts; roller track, drive belt pulley and door carrier systems are not adjustable to compensate for wear and distortion in the system caused by the continuous stress of operation and the expansion and contraction of the building resulting in unnecessary malfunctions, repairs and replacements; the operation of opening and closing the sliding doors is not adjustable; and repairs, service and replacement of components by users is complicated by non-standard replacement parts, non-availability of parts and limited accessibility to components of the system. The instant invention overcomes these deficiencies and inadequacies by providing for components and systems which are adjustable and adaptable for installation in new and existing buildings and for compensation of structural distortions. Repair, service and replacement operations by users are improved by easy access to components and availability of parts which are interchangeable and standardized throughout the industry.

BRIEF DESCRIPTION OF THE INVENTION

The present invention relates to a new and improved sensor activated, automatic door assembly comprising an operator-header support beam and cover, an adjustable roller track assembly, a carrier roller, an anti-riser roller, a door carrier assembly, an adjustable drive belt and pulley assembly, a magnetic switch assembly, a door stop plate assembly, a variable speed and direction drive motor, hinged sliding door assembly, hinged fixed door assembly, sliding door guide and sensor device. The operator-header support beam a J-shaped, modified I-beam mounted horizontally in a building opening as a header provides the main support and attachment apparatus for the components of the system, provides increased support strength and may be modified to adapt to various building front surfaces. The support beam may be modified to allow attachment to a vertical surface of a building to function as a header. A cover bracket attaches to both sides of the support beam by snap-in connection into specially machined grooves on the support beam to house certain components of the system and removes easily to provide increased accessibility for service, repair and replacement of system parts. The beam covers are retained in position by the snap-in contact with the support beam and edge-wise impingement with the sides of the building opening. A linear roller track assembly is mounted horizontally on the entire length of the operator-header support beam by a plurality of common bolts connected to the roller track through vertically disposed apertures in the roller track which allows vertical adjustment of the roller track by loosening, tightening and vertical displacement of the bolts and roller track. This permits vertical adjustment of the sliding doors which are suspended from the roller track and for adaption and compensation of the system to building installation conditions and subsequent structural distortions caused by the stress of operation, expansion and contraction. The sliding doors are attached to the door carrier assembly which is suspended astride the top of the adjustable roller track by carrier rollers which permit travel along the length of the roller track. The carrier rollers mount astride and flush with the top of the roller track. The rotational axis of each carrier roller is horizontally disposed and connected perpendicularly to the door carrier which is vertically disposed. The carrier rollers allow the door carrier to travel the entire length of the support beam. The sliding doors are vertically suspended from the carrier rollers by connection with the door carrier. Anti-riser rollers attach to the door carrier assembly and mount flush with the bottom of the roller track stabilizing the movement of the door carrier assembly along the roller track and preventing removal of the door carrier assembly from the roller track by prohibiting vertical displacement of the carrier rollers. The rotational axis of each anti-riser roller is horizontally disposed and connected perpendicularly to the door carrier. The door carrier assembly attached to a drive belt and adjustable pulley assembly is propelled along the roller track assembly by a variable speed and direction drive motor connected to the drive belt. An angle iron vertically disposed and attached to the door carrier is connected and affixed to the drive belt above the door carrier by a supporting block. The drive belt forms a continuous loop by connection with the pulley at one end of the support beam and with the variable speed and direction drive motor at the other end of the support beam, all located above and on the same side of the support beam as the roller track. The drive belt is a well known timing belt. The pulley mounted on a bracket connected to the support beam allows change of direction of the drive belt. The pulley bracket is attached to the support beam by at least two well known common bolt connectors inserted through the bracket and through elongated horizontal apertures in the support beam adjacent to the pulley bracket. Horizontal adjustment of the pulley bracket is accomplished by horizontal displacement of the pulley bracket and corresponding horizontal displacement and fastening of the bolt connectors within the horizontal apertures. The variable speed and direction drive motor controlled by a magnetic switch assembly regulates the speed and direction of the sliding doors along the roller track. The magnetic switch assembly is controlled by the operation of magnetic switches situated on the operator-header support beam along the path of the supporting block on the door carrier and magnetic sensing tape attached to the supporting block on the door carrier as it travels along the roller track. The magnetic switch control box connects to the magnetic switches which sense the magnetic tape on the door carrier to determine the location and direction of the sliding doors. The magnetic control box connects to the drive motor to vary its speed and direction to regulate the movement of the sliding doors. The variable speed and direction drive motor is activated by a sensor device positioned in the vicinity of the doors to initially open the sliding doors. For safety the fixed and sliding doors are provided a pivotal vertical-axis safety hinge at one end of the door to permit opening of the door by rotation about that axis in an emergency to effect exit from the building. For the fixed doors the vertical-axis safety hinge includes a round rod vertically disposed affixed to and connecting the door and the support beam at the top and the door and the floor at the bottom to permit rotation of the door about the vertical axis of the safety hinge. For the sliding doors the upper vertical-axis safety hinge is a round rod vertically disposed affixed to and connecting the door and door carrier at the top of the door and the lower vertical axis safety hinge is a round rod vertically disposed affixed to and connecting the door and sliding door guide at the bottom to permit rotation of the door about the vertical axis of the safety hinge. The doors and rotatable safety hinges may be positioned in any number of configurations to allow rotational openings in different directions. The fixed doors are prevented from rotating in the wrong direction by impinging against a door stop plate mounted in the bottom of the support beam. The fixed doors are prevented from rotating in the permissible direction by the contact of a magnet mounted on the fixed door with the door stop plate. When the fixed doors are rotated in their permissible direction a door stop magnetic switch situated in the support beam connected to the magnetic control box senses the movement of the door and interrupts electrical power to the automatic doors to prevent movement of the sliding doors. The sliding door guide assembly is a well known cam follower protruding from the bottom of the sliding door and mounted so that its axis of rotation is vertical and attaches to the bottom of the door. The cam follower inserts into a recessed rectangular guide channel on the floor of the building opening parallel to the support beam. The cam follower suspended by the sliding door in the guide channel stabilizes movement of the sliding door by restricting lateral displacement perpendicular to the direction of movement when the surface of the cam follower impinges against the vertical wall of the guide channel. Since the cam follower is suspended by the door in the guide channel there is no contact and friction between the floor of the guide channel and the cam follower resulting in smooth movement of the sliding doors and longer component life for the cam follower. The adjustable roller track, carrier rollers, anti-riser rollers and sliding door guide operate together to stabilize the movement of the sliding door and allow adjustment of the components to compensate for distortion in the system and building structure.

In an alternative embodiment in lieu of the roller track a cylindrical support rod is mounted on the support beam to function as a linear support track. A linear antifriction bearing is mounted on the support rod and travels linearly back and forth along the rod. The antifriction linear bearing may utilize a ball-bearing or bushing apparatus to provide for relatively frictionless movement along the support rod. The linear bearing utilizes an outer housing so that either the ball-bearing or bushing apparatus may be inserted to provide contact with the support rod. The bushing type apparatus emplaced in the linear bearing housing may employ a friction bearing inner core of material such as metal or plastic material, such as NYLONTRON, to provide slideable contact with the support rod. A cylindrical passage way along the longitudinal axis of the bushing accommodates the support rod. This bushing apparatus eliminates the deficiency of existing systems where ball bearings corrode and rollers crack or melt during a fire. If the plastic rollers melt during intense heat the doors will drop down from the roller track and jam in the track or groove usually found at the foot of the door in the floor. The jamming of the doors in a fire situation is extremely dangerous and is alleviated by the instant invention. Even if the friction bearing core melts the door will only drop the length of the core thickness, usually about 0.5 inches. This will allow the doors to continue to slide open.

In another embodiment of the linear bearing a ball-bearing apparatus which utilizes ball bearings in a continuous race to slide along the support rod may be emplaced in the linear bearing housing. This bearing is cylindrical with a cylindrical passage-way centered and along the longitudinal axis of the bearing to accommodate the support rod. A hardened, plastic-like material forms a cage of uniform thickness contiguous to the linear bearing housing defining a plurality of dual-channel raceways to house the ball-bearings. The raceways are situated along the circumference of the passage way parallel to the longitudinal axis of the passage-way. The two channels, inner and outer, are situated in tandem in the cage generally along a plane radiating from the center of the bearing perpendicular to the outer surface of the bearing. The inner channel is adjacent to the passage way. The inner channel is adjacent to the support rod and contains an open groove parallel to the channel juxtaposed to the support rod. This groove and the restricted width of the inner channel forces a portion of the surface of the ball bearings to protrude slightly through the groove and into the passages way to impinge against the support rod during its travel through the passage way. The dual channels are parallel and form a closed, continuous raceway for a plurality of ball bearings to move freely within. The ball bearings move generally uniformly in one direction in one channel and in the opposite direction in the adjacent channel when the bearing is being moved in one direction. The ball bearings in the channel immediately adjacent to the support rod will move in the opposite direction as the bearing. Upon change of direction of the bearing the ball bearings will reverse their direction of travel. The impingement of the support rod against the surface of the free moving ball-bearings provides for relatively frictionless movement of the bearing along the support rod.

Two or more bearings are attached to the door carrier to permit travel of the door along the rod. The bearings are adjustably mounted to the door carrier to allow vertical adjustment. The rod may be of stainless steel, $\frac{3}{4}$ inch in diameter, and is inserted within the bearing with a tolerance of approximately 0.001 inch. Felt wipers are provided at the two end openings to clean the support rod during ingress into the bearing to prevent friction wear between the support rod and friction bearing core.

It is a primary objective of this invention to provide an operator-header support beam which has increased support strength and is adaptable to various installation conditions and various building surfaces.

A further objective of this invention is to provide an adjustable drive belt and pulley system to compensate for distortion.

Yet a further objective of this invention is to provide a door carrier assembly, carrier rollers and anti-riser rollers to stabilize the movement of the sliding doors and prevent removal of the doors.

There is yet another objective of this invention to provide a magnetic switch assembly for adjustable regulation of the operation of the sliding doors.

It is a further objective of this invention to provide a door with a vertical pivotal assembly for rotational hinged opening in emergencies.

It is yet a further objective of this invention to provide a sliding door guide for restraint of the bottom of the sliding door during movement.

It is yet a further objective of this invention to provide a linear bearing for movement of the doors along a linear support rod.

It is yet a further objective of this invention to provide a ball-bearing apparatus for placement in the bearing housing of the linear bearing to achieve relatively frictionless movement of the linear bearing along the support rod.

It is yet a further objective of this invention to provide a bushing apparatus for placement in the bearing housing of the linear bearing to achieve relatively frictionless movement of the linear bearing along the support rod.

PREFERRED EMBODIMENT OF THE INVENTION

Figures 1, 2, 3, 4, 5:
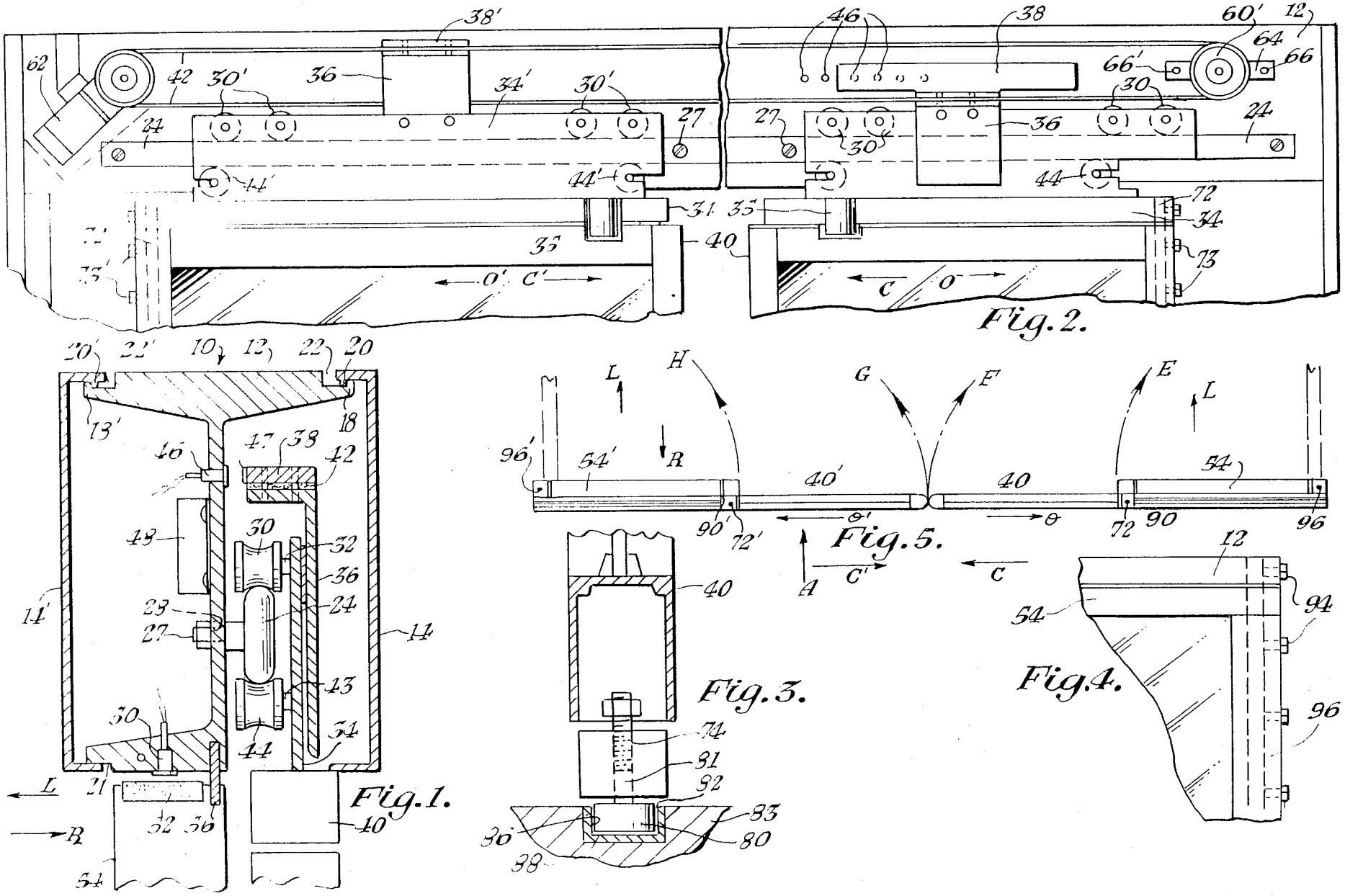
FIG. 1 shows a side elevational cut away view of the instant invention.
FIG. 2 shows a frontal elevational view of the instant invention with support beam cover removed.
FIG. 3 is a side elevational cut away view of the sliding door guide.
FIG. 4 is a frontal elevational view of a fixed door with a perspective view of the upper safety hinge.
FIG. 5 is a top plan view of the sliding and fixed doors of the instant invention with a perspective view of the safety hinges.

Referring now in detail to the drawings in FIGS. 1 through 9, inclusive, and in particular to FIG. 1, there is shown a cross-sectional, elevational view of the operator header, generally designated as numeral 10. Support beam 12 of the operator header is a J-shaped, modified I-beam mounted horizontally in a building opening (not shown) as a header. The support beam 12 may be modified to allow attachment to the vertical surface of a building front to function as a header. Cover bracket 14 and 14' attaches to both sides of support beam 12 by snap-in connection between beam flange protuberance 18 and 18' and cover protuberance 20 and 20' with beam groove 22 and 22' and 21 on support beam 12. Linear roller track 24 is mounted horizontally to the entire length of support beam 12 by a plurality of fasteners including common fastener 27, such as bolts or screws, connected to roller track 24 through vertically disposed, elongated beam aperture 28 in support beam 12 to allow vertical adjustment of roller track 12 by loosening, tightening and vertical displacement of common fastener 27 within beam aperture 28. Adjustment of roller track 24 permits vertical adjustment of sliding door 40 which is suspended from roller track 24. Sliding door 40 is connected to door carrier 34 which is suspended astride the top of roller track 24 by a plurality of carrier rollers 30 which permits sliding door 40 to travel along the length of roller track 24. Carrier rollers 30 mounts astride and flush with the top of roller track 24. Rotational axis 32 of carrier rollers 30 is horizontally disposed and connected perpendicularly to door carrier 34 which is vertically disposed. Carrier rollers 30 allows door carrier 34 to travel the entire length of support beam 12. Sliding door 40 is vertically suspended from carrier rollers 30 by connection with door carrier 34. A plurality of anti-riser rollers 44 connect to door carrier assembly 34 and mount flush with the bottom of roller track 24 stabilizing the movement of door carrier 34 along roller track 24 and preventing removal of door carrier 34 assembly from roller track 24 by prohibiting vertical displacement of carrier roller 30. Rotational axis 43 of anti-riser roller 44 is horizontally disposed and connected perpendicularly to door carrier 34. Angle iron 36 vertically disposed and connected to door carrier 34 is connected and affixed to drive belt 42 above door carrier 34 by supporting block 38. Door carrier 34 connected to drive belt 42 by angle iron 36 is propelled along roller track 24 by a variable speed and direction drive motor 62 (shown in FIG. 2) connected to drive belt 42. Magnetic switch control box 48 is connected to support beam 12. Magnetic switch control box 48, is connected to a plurality of sliding door magnetic switches 46 situated on support beam 12 along the path of travel of supporting block 38. Magnetic sensing tape 47, attached, to supporting block 38 activates magnetic switches 46 as supporting block 38 travels along roller track 12 connected to sliding door 40. Magnetic switch control box 48 connects to a plurality of magnetic switches 46 which sense magnetic tape 47 on support block 38 to determine the location and direction of sliding door 40. Magnetic control box 48 connects to the variable speed and direction drive motor 62 (shown in FIG. 2) to vary its speed and direction to regulate the movement of the sliding door 40 in response to its location and direction along support beam 12. Fixed door 54 is prevented from rotating in direction R by impinging against door stop plate 56 mounted in the bottom of support beam 12. Fixed door 54 is prevented from rotating in direction L by the contact of magnet 52 mounted on fixed door 54 adjacent to door stop plate 56. When fixed door 54 is rotated in direction L door stop magnetic switch 50 situated in support beam 12 and connected to magnetic switch control box 48 senses the movement of magnet 52 on fixed door 54 and interrupts electrical power to the variable speed and direction drive motor 62 to prevent movement of sliding door 40.

Referring now to FIG. 2 operator header 10 is shown with support beam cover 14 removed. Support beam 12 is shown in a configuration with two sliding doors, 40 and 40', with their corresponding components. One or more fixed door 54 could be used in conjunction with this configuration depending on the size of the building opening and the desired mode of opening and closing the sliding doors 40 and 40'. For simplicity the fixed door 54 is not shown in this drawing but its operation would be the same as described in these specifications. A drive belt 42 forms a continuous loop by connection about pulleys 60, 60' located at opposite ends of support beam 12 and with variable speed and direction drive motor 62 at the other end of support beam 12, all located above and on the same side of support beam 12 as roller track 24. Pulley 60' mounted on bracket 64 connected to support beam 12 allows change of direction of drive belt 42. Pulley bracket 64 is attached to support beam 12 by at least two well known common bolt 66 and 66'. Elongated horizontal apertures in either support beam 12 or pulley bracket 64 allows horizontal adjustment of pulley bracket 64 by horizontal displacement of pulley bracket 64 and corresponding horizontal displacement and fastening of bolt 66 and 66' within the horizontal apertures. Variable speed and direction drive motor 62 regulates the speed and direction of sliding door 40 and 40' along roller track 12 by connection with drive belt 42. Variable speed and direction drive motor 62 is initially activated by a sensor device (not shown) positioned in the vicinity of sliding door 40 and 40'. Roller track 24 connected to support beam 12 by adjustable fasteners 27 supports door carrier 34 and 34' support sliding doors 40 and 40', respectively.

A plurality of anti-riser rollers 44 prevents removal of sliding door 40 and 40' from roller track 24. Angle iron 36 and 36' are shown connected to door carrier 34 and 34', respectively, and drive belt 42. Supporting block 38 and 38' may attach to either the upper or lower strand of the loop formed by drive belt 42 to determine whether sliding door 40 and 40' move in opposite directions or in a parallel direction. FIG. 2 shows the attachment configuration to drive belt 42 to cause sliding door 42 and 42' to move in opposite directions to open and close. Supporting block 38 is shown adjacent to a plurality of magnetic switches 46. In the configuration shown in FIG. 2 and FIG. 5 the sliding door 40 and 40' would be positioned adjacent and centered under support beam 12, when in the closed position. The remaining area under support beam 12, on either side of sliding door 40 and 40', would be occupied by fixed door 54 and 54'. A sensor device detects an individual approaching the automatic doors and activates the variable speed and direction drive motor 62 to propell drive belt 42 to open sliding door 40 and 40' by moving them in directions 0 and 0', respectively. In this embodiment drive motor 62 may cause the doors to initially open rapidly and subsequently slow as they approach the full open position as shown in FIG. 5. Once sliding doors 40 and 40' reach the full open position 90 and 90', respectively, (shown in FIG. 5) they will pause and then move rapidly in direction C and C', respectively, slowing to the closed position. A plurality of magnetic switches 46 sense the location of sliding door 40 along roller track 24 to regulate the speed and direction of sliding door 40 and 40' by connection to drive motor 62. The sliding door upper vertical axis safety hinge 72 and 72' connected to sliding door 40 and 40', respectively, and door carrier 34 and 34', respectively, are identical in structure, connection and operation and the following description of safety hinge 72 is applicable to safety hinge 72'. Sliding door lower vertical axis safety hinge 74 (shown in FIG. 3) and 74' (not shown) connected to sliding door 40 and 40', respectively, are identical in structure, connection and operation and the following description of safety hinge 74 is applicable to safety hinge 74'. Safety hinge 72 is a round rod, vertically disposed, connected and affixed to sliding door 40 and door carrier 34 by a plurality of common fasteners 73, such as screws or bolts. Sliding door 40 is connected to and suspended from door carrier hinge 35. Door carrier hinge 35 provides a breakaway connection between door carrier 34 and sliding door 40 to permit horizontal rotation of sliding door 40 about the vertical axis of upper safety hinge 72 and the vertical axis of lower safety hinge 74 when force is applied to sliding door 40 in direction A (as shown in FIG. 5), and direction L (as shown in FIG. 1).

Referring now to FIG. 3, the sliding door guide 80 is a well known cam follower attached to the bottom of sliding door 40 and mounted so that its rotational axis 81 is vertical and attaches to the bottom of door 40. Door guide 80 inserts into recessed rectangular guide channel 82 on floor 83 of the building opening parallel to support beam 12. At least one door guide 80 will be suspended by sliding door 40 in guide channel 82 to stabilize movement of sliding door 40 by restricting lateral displacement of sliding door 40 perpendicular to its direction of travel by surface of door guide 80 impinging against vertical wall 86 of guide channel 82. Since the door guide 80 is suspended by sliding door 40 in guide channel 82 there is no contact and friction between floor 88 of guide channel 82 and door guide 80, resulting in smooth movement of sliding door 40. Adjustable roller track 24, carrier roller 30, anti-riser roller 44 and sliding door guide 86 operate together to stabilize the movement of the sliding door and allow adjustment of these components to compensate for distortion in the system and building structure. The door guide 80 shown in FIG. 3 includes sliding door lower vertical axis safety hinge 74, a round rod, vertically disposed, connected and affixed to door guide 80 and sliding door 40. Door guide 80 which includes safety hinge 74 is positioned directly under safety hinge 72 in a vertical plane to allow rotation of sliding door 40 about the vertical axis of safety hinge 72 and 74.

Referring now to FIG. 4, a fixed door safety hinge 96 is a round rod, vertically disposed, connected and affixed to fixed door 54 and support beam 12 by a plurality of common fastener 94, such as screws or bolts. A similar safety hinge 98 (not shown) is mounted at the bottom of fixed door 54 to connect fixed door 54 to the floor of the building opening occupied by the automatic doors. Safety hinge 96 and 98 (not shown) are positioned in fixed door 54 in a vertical plane so that fixed door 54 may be rotated about the vertical axis of safety hinge 96 and 98 as shown in FIG. 5.

FIG. 5 shows one embodiment of the automatic door assembly utilizing the safety hinges. Fixed doors 54 and 54' are stationary and sliding doors 40 and 40' are shown in their closed position with direction 0 and 0' demonstrating their mode of operation, for opening, and direction C and C' demonstrating their mode of operation for closing. Position 90 and 90' shows sliding door 40 and 40' in the closed position. In an emergency if pressure is applied in direction A to any or all of the doors they will respond by rotating about the vertical axis of their safety hinges. Proceeding from the left side of FIG. 5, when pressure is exerted in direction A: fixed door 54 will rotate about safety hinge 96' and 98' (not shown) in direction L through arc H; sliding door 40' will rotate about safety hinge 72' and 74' (not shown) in direction L through arc G; sliding door 40 will rotate about safety hinge 72 and 74 (not shown) in direction L through arc F; and fixed door 54 will rotate about safety hinge 96 and 98 (not shown) in direction L through arc E. If at any time during operation of the sliding doors pressure is exerted in direction A to move fixed door 54 or 54' the fixed door magnet 52 (shown in FIG. 1) will break contact with fixed door stop 56 resulting in electrical power to drive motor 62 (FIG. 2) being interrupted and sliding door 40 and 40' will stop to allow rotation about their safety hinges and exit through the automatic doors. If pressure is applied in direction R rotation of fixed door 54 or 54' in direction R will be prevented by impingement against fixed door stop 56 (shown in FIG. 1) and rotation of sliding door 40 or 40' in direction R will be prevented by the retaining power of door carrier hinge 35 and 35' (shown in FIG. 2).

Figure 6:
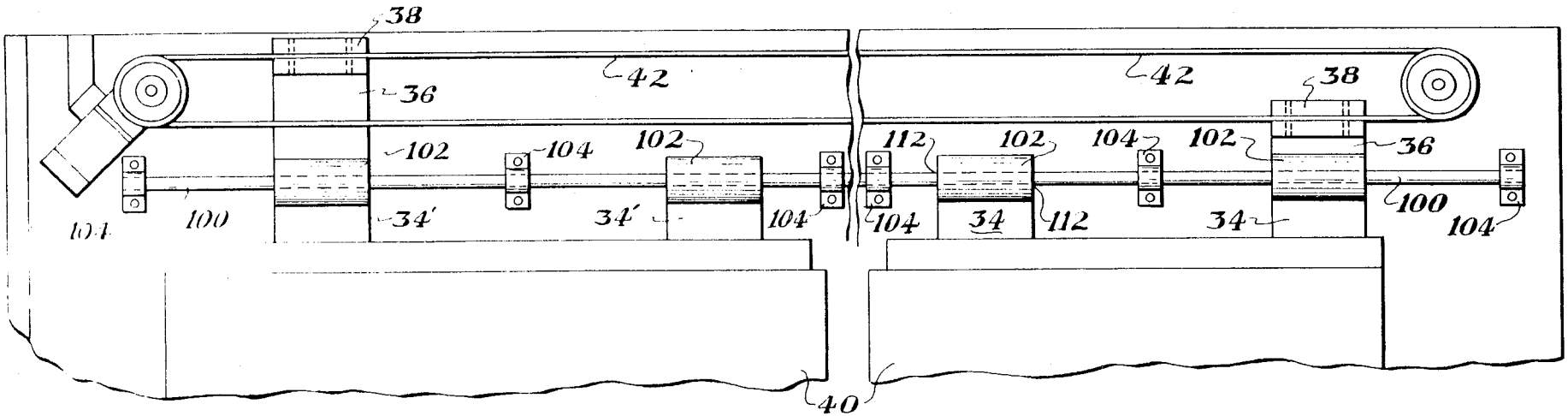
FIG. 6 is a side elevational view of the sliding door system with the linear bearings and support rods.
Figure 7:
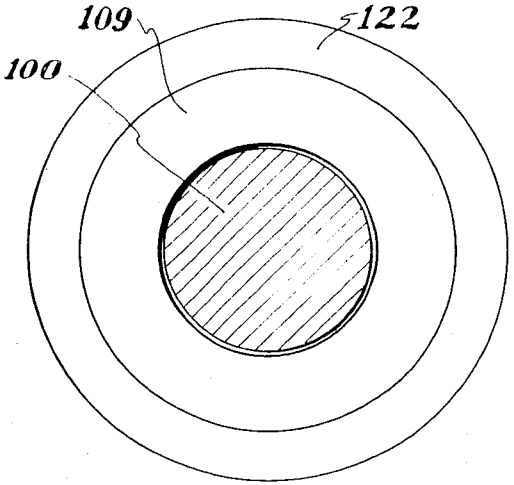
FIG. 7 frontal elevational cut away view of the linear bearing with bushing apparatus.
Figure 9:
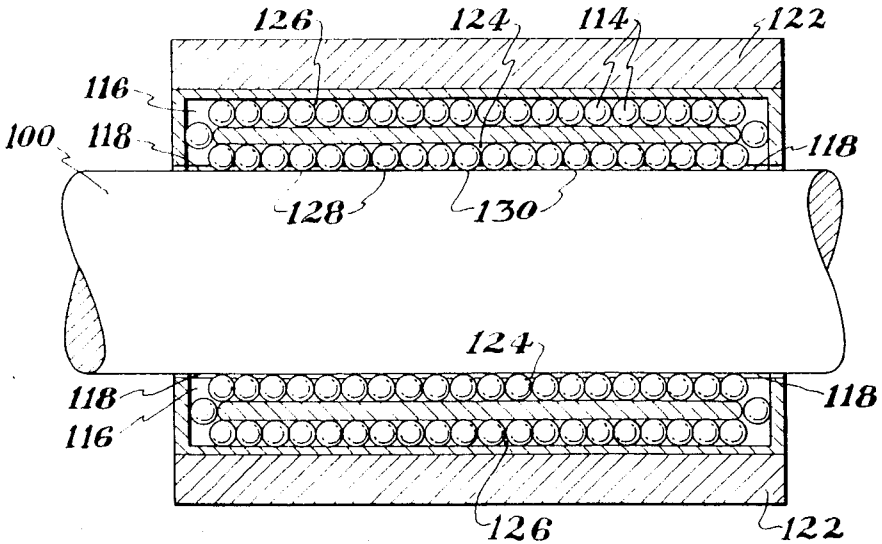
FIG. 9 is a side elevational cut away view of the linear bearing with ball-bearing apparatus.
Figure 8:
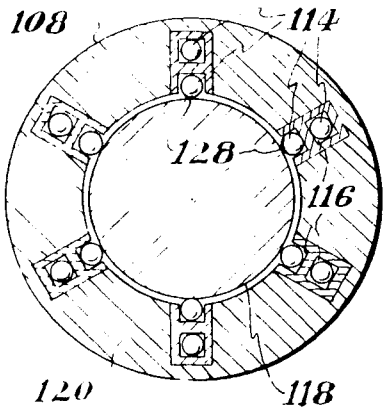
FIG. 8 is a frontal elevational cut away view of the linear bearing with ball-bearing apparatus.

In the alternative embodiment of the instant invention with the linear bearing as shown in FIGS. 6, 7, 8, and 9, in lieu of the roller track 24 a cylindrical support rod 100 is mounted by brackets 104 on the support beam 12. Support rod 100 may be used for a single door or for several doors. In the preferred embodiment brackets 104 are placed at each end of support rod 100 to allow movement of a single door. FIG. 6 shows the instant invention as set forth in FIGS. 1 through 5, inclusive, with the alternative embodiment of linear bearings 102 in place of the carrier rollers 30. A linear support rod 100 is used in place of the roller track 24. A linear bearing 102 is inserted on the support rod 100 and travels back and forth along the rod 100. The linear bearing 102 (as shown in FIGS. 7, and 9) is a linear bearing type apparatus with a linear bearing housing 122 to retain any friction-bearing core such as a ball bearing apparatus 108 (as shown in FIGS. 8 and 9) or a bushing type apparatus 109 (as shown in FIG. 7) both provided with a passageway 118 along its longitudinal axis to accommodate the support rod 100. Two or more linear bearings 102 are attached to door carrier 34 or 34' to permit required travel of the door 40 along th rod 100. The linear bearings 102 are adjustably mounted to the door carrier 34 or 34' to allow vertical adjustment. The support rod 100 may be of stainless steel, ¾ inch in diameter, and inserted within the bearing 102 with a tolerance of approximately 0.001 inch. Felt wipers (not shown) may be provided at the two bearing end openings 112 to clean the support rod 100 during ingress into the linear bearing 102 to prevent wear caused by particles between the support rod 100 and ball bearing apparatus 108 or bushing apparatus 109. Angle iron 36 is attached to linear bearing 102 and the drive belt 42 to propell the linear bearing 102 along support rod 100.

In FIGS. 8 and 9 an alternative embodiment of linear bearing 102 is provided employing a ball-bearing apparatus 108 which utilizes a plurality of ball bearings 114 in a continuous race 116 to slide along the support rod 100. Linear bearing housing 122 may be any shape as long as it provides contigious insertion for the friction-bearing core such as in apparatus 109. The friction bearing core may be any shape as long as it accommodates support rod 100. As represented in this embodiment linear bearing 102 is cylindrical with a cylindrical passage-way 118 centered and along the longitudinal axis of linear bearing 102 to accommodate the support rod 100. A hardened, plastic-like material forms a generally solid cage 120 of uniform thickness contiguous to the linear bearing housing 122 of linear bearing 102 defining a plurality of dual-channel raceways 116, with an inner channel 124 and an outer channel 126, to house a plurality of ball-bearings 114. The raceways 116 are situated along the circumference of the passage-way 118 parallel to its longitudinal axis. The two channels 126 and 124, are situated in tandem in cage 120 generally along a plane radiating from the longitudinal axis of the bearing 102 perpendicular to the outer surface of the bearing 102. The inner channel 124 is adjacent to the passage way 118. The channel 124 immediately adjacent to the support rod 100 contains an open groove 128 parallel to inner channel 124 juxtaposed to the support rod 100. This groove 128 and the restricted width of the inner channel 124 forces a portion of the surface 130 of the ball bearings 114 to protrude slightly through the groove 128 and into the passage-way 118 to impinge against the support rod 100 during its travel through the passageway 118. The dual channels 124 and 126 are parallel and form a closed, continuous raceway 116 for a plurality of ball bearings 114 to move freely within. Ball-bearings 114 move generally uniformly in one direction in one channel and in the opposite direction in the adjacent channel when the bearing 102 is being moved in one direction. The ball bearings 114 in the channel 124 immediately adjacent to the support rod 100 will move in the opposite direction as the linear bearing 102. Upon change of direction of linear bearing 102 the ball bearings 114 in channels 124 and 126 will reverse their direction of travel. The impingement of the support rod 100 against the surface 130 of the free moving ball-bearings 114 provides for relatively frictionless movement of linear bearing 102 along the support rod 100.

In FIG. 7 is shown an alternative embodiment of the linear bearing apparatus of linear bearing 102 which is inserted into linear bearing housing 122. The linear bearing apparatus is a bushing apparatus 109 which may be any shape as long as it accommodates support rod 100. Bushing apparatus 109 is shown as cylindrical with a hollow passage-way parallel to the longitudinal axis of the linear bearing housing 122 to accommodate passage of support rod 100. Bushing apparatus 109 is contiguous to the linear bearing housing 122 and is generally flush with the support rod 100 to allow generally frictionless movement of the linear bearing 102 along support rod 100.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An automatic door assembly for a building entrance opening, comprising:

a support header means;

a support means connected horizontally to the building entrance opening for supporting and enclosing the components of the automatic door assembly;

a door assembly means connected to the support header means for suspending, supporting and guiding a door means;

a drive means connected to the door assembly means for propelling the door assembly means; and a control means connected to the drive means for regulating the drive means;

said door assembly means includes a linear track means connected horizonatally to the support header means by a plurality of adjustable attachment means for supporting a door carrier means, said adjustable attachment means is a fastener means connected to a vertically disposed elongated aperture in the support header means, said adjustable attachment means connected to the linear track means for varying the vertical displacement of the linear track means on the support header means by vertical displacement of the fastening means within the vertically disposed apertures in the support beam;

a door carrier means vertically disposed connected to the linear track means by a plurality of sliding means for supporting a sliding door from the linear track means, said sliding door connected to the door carrier means by a safety hinge means;

said sliding means connected to the door carrier means for allowing travel of the door carrier means along the length of the linear track means;

an angle iron means connected to the door carrier means for attaching to a drive belt means for propelling the door carrier means along the linear track means;

means connected to the angle iron for affixing a drive belt means to said angle iron and for mounting magnetic sensing tapes;

a fixed door connected to said support header means;

a fixed door stop plate means connected to said support header means for preventing movement of the fixed door in a specific direction, a fixed door magnet means connected to the fixed door for magnetically contacting with the fixed door stop plate means to prevent movement of the fixed door in a specific direction unless sufficient force is applied to break the magnetic contact;

at least one sliding door guide means connected to the bottom of the sliding door for guiding and restraining the movement of the sliding door during movement along the support beam header means;

a fixed door rotatable safety hinge means connecting the fixed door to the support header means and floor of the building entrance opeing for allowing rotation of the fixed door horizontally about a vertical axis in a specific direction upon application of pressure against the fixed door;

a sliding door rotatable safety hinge means connecting the sliding door to the door carrier means and sliding door guide means for allowing rotation of the sliding door horizontally about a vertical axis in a specific direction upon an application of pressure against the sliding door.

2. An automatic door assembly as recited in claim 1, wherein:

said linear track means is a well known roller track;

said sliding means includes a plurality of carrier rollers and anti-riser rollers connected to said roller track;

said carrier roller connected by a horizontally disposed rotational axis to the door carrier means for allowing travel of the door carrier means along the length of the roller track, said rotational axis of the carrier roller is connected perpendicularly to the door carrier means, the carrier roller is mounted flush on the top of the roller track;

said anti-riser rollers connected to the door carrier means for preventing removal of the door carrier means from the roller track and for stabilizing movement of the door carrier on the roller track by restraining vertical displacement of the door carrier means, said anti-riser means is connected to the door carrier means by a horizontally disposed rotational axis, said rotational axis of the anti-riser roller is connected perpendicularly to the door carrier means, the anti-riser means is mounted flush to the bottom of the roller track.

3. An automatic door assembly as recited in claim 2, wherein: said drive belt means is a well-known timing belt.

4. An automatic door assembly as recited in claim 1, wherein:

said linear track means is a linear support rod connected generally horizontal to the support beam header means;

said sliding means is a plurality of linear bearings connected to said linear support rod.

5. An automatic door assembly as recited in claim 4, wherein:

said linear bearing includes a friction bearing means for providing relatively frictionless movement along said support rod, said friction bearing means connected to a linear bearing housing, said linear bearing housing adjustably connected to said door carrier means.

6. An automatic door assembly as recited in claim 5, wherein:

said friction bearing means is a ball-bearing apparatus with a passage-way to accommodate said support rod, said ball-bearing apparatus has a plurality of tandem channel raceways housing a plurality of ball-bearings, said raceways generally parallel and juxtaposed to said passage-way, said ball bearings impinge against said support rod, said ball-bearings apparatus continguous to said linear bearing housing.

7. An automatic door assembly as recited in claim 5, wherein:

said friction bearing means is a bushing apparatus with a passage-way to accommodate said support rod, said bushing apparatus contiguous to said linear bearing housing.

8. An automatic door assembly as recited in claim 1, wherein:

said sliding door guide means is a well known cam follower means connected to the bottom of the sliding door by a vertically disposed rotational axis suspended in a channel parallel with the support beam header means for restraining the lateral displacement of the sliding door during movement of the sliding door by impinging against the walls of the channel.

9. An automatic door assembly as recited in claim 1, wherein:

said fixed door rotatable safety hinge means is around rod means vertically disposed connected to the top and bottom of said fixed door in a vertical plane for allowing said fixed door to rotate horizontally about the vertical axis of the round rod means.

10. An automatic door assembly as recited in claim 1, wherein:

said sliding door rotatable safety hinge means is around rod means vertically disposed connecting the top of the sliding door to the door carrier means and the bottom of the sliding door to the sliding door guide means in a vertical plane for allowing said sliding door to rotate horizontally about the vertical axis of the round rod means.

11. An automatic door assembly for a building entrance opening, comprising:

a support header means;

a support means connected horizontally to the building entrance opening for supporting and enclosing the components of the automatic door assembly;

a door assembly means connected to the support header means for suspending, supporting and guiding a door means;

a drive means connected to the door assembly means for propelling the door assembly means; and a control means connected to the drive means for regulating the drive means;

said drive means includes a variable speed and direction drive motor means connected to a drive belt means for propelling said drive belt means at various speeds and in alternating directions, said variable speed and direction drive motor means is connected to the support header means on the same side as the linear track means;

a pulley assembly means connected to the same side of the support header means as the drive motor means and linear track means for connecting with the drive belt means to form a continuous loop of the drive belt means generally the length of the support header means parallel with the linear track means, said pulley assembly means includes a pulley means connected to a bracket means, said bracket means connected to the support beam header means by a plurality of bracket attachment means;

said drive belt means connected to an angle iron for propelling the door carrier means along the linear track means at various speeds and in alternating direction said angle iron connected to said door assembly means, and said control means includes a plurality of magnetic switch means connected to the support header means for sening magnetic tape connected to a supporting means fixed with respect to the door carrier means as the door carrier means is propelled along the linear track means, the magnetic switch means connected to a switch control box for determining the direction and speed of the sliding door along the linear track means;

a sliding door stop switch means connected to the support beam header means for sensing the movement of a fixed door magnetic means attached to the top of a fixed door adjacent to said sliding door stop switch means from a stationary position;

said switch control box means connected to the variable speed and direction drive motor means for varying the speed and direction of the drive motor according to the location, speed and direction of the door carrier means as sensed by the magnetic switch means, said switch control box means connected to the sliding door step switch means for interrupting electrical power to the drive motor means when said sliding door stop switch means senses movement of the fixed door magnet means from a stationary position.

12. An automatic door assembly for a building entrance opening comprising:

a support header means connected horizontally to the building entrance opening for supporting and enclosing the components of the automatic door assembly;

a door assembly means connected to the support header means for suspending supporting and guiding a door means;

a drive means connected to the door assembly means for propelling the door assembly means; and a control means connected to the drive means for regulating the drive means;

said control means includes a plurality of magnetic switch means connected to the support header means for sensing magnetic tape connected to a supporting means fixed with respect to the door carrier as the door carrier means is propelled along the linear track means, the magnetic switch means connected to a switch control box for determining the direction and speed of the sliding door along the linear track means;

a sliding door stop switch means connected to the support header means for sensing the movement of a fixed door magnetic means attached to the top of a fixed door adjacent to said sliding door stop switch means from a stationary position;

said switch control box means connected to the variable speed and direction drive motor means for varying the speed and direction of the drive motor according to the location, speed and direction of the door carrier means as sensed by the magnetic switch means, said switch control box means connected to the sliding door stop switch means for interrupting electrical power to the drive motor means when said sliding door stop switch means senses movement of the fixed door magnet means from a stationary position.

* * * * *